US011052441B2

(12) United States Patent
Yamasaki et al.

(10) Patent No.: US 11,052,441 B2
(45) Date of Patent: Jul. 6, 2021

(54) MEANDERING CONTROL DEVICE FOR ROLLING LINE

(71) Applicant: TOSHIBA MITSUBISHI—ELECTRIC INDUSTRIAL SYSTEMS CORPORATION, Chuo-ku (JP)

(72) Inventors: Yukihiro Yamasaki, Tokyo (JP); Naohiro Kubo, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 289 days.

(21) Appl. No.: 15/533,807

(22) PCT Filed: Feb. 2, 2015

(86) PCT No.: PCT/JP2015/052805
§ 371 (c)(1),
(2) Date: Jun. 7, 2017

(87) PCT Pub. No.: WO2016/125226
PCT Pub. Date: Aug. 11, 2016

(65) Prior Publication Data
US 2017/0326605 A1 Nov. 16, 2017

(51) Int. Cl.

| | |
|---|---|
| ***B21D 45/00*** | (2006.01) |
| ***B21B 37/68*** | (2006.01) |
| ***B21B 37/76*** | (2006.01) |
| *B21B 37/74* | (2006.01) |
| *B21B 45/00* | (2006.01) |

(52) U.S. Cl.
CPC ..... *B21B 37/68* (2013.01); *B21B 37/76* (2013.01); *B21B 37/74* (2013.01); *B21B 45/004* (2013.01);
(Continued)

(58) Field of Classification Search
CPC ..... B21B 37/48; B21B 37/58; B21B 37/74; B21B 2265/02; B21B 2265/04;
(Continued)

(56) References Cited

U.S. PATENT DOCUMENTS 5,927,118 A * 7/1999 Minote ..... B21B 37/28 72/11.3
9,547,290 B2 * 1/2017 Dagner ..... B21B 37/58
(Continued)

FOREIGN PATENT DOCUMENTS

JP 04118186 A * 4/1992 ..... B21B 37/68
JP 08295949 A * 11/1996
(Continued)

OTHER PUBLICATIONS

Translation of JP2009285694, Author: Kachi. Translated May 2019 (Year: 2008).*
(Continued)

*Primary Examiner* — Debra M Sullivan
*Assistant Examiner* — Matthew Kresse
(74) *Attorney, Agent, or Firm* — Xsensus LLP

(57) ABSTRACT

There is provided a meandering control device for a rolling line capable of setting temperature of a material to be rolled so as to suppress meandering of the material to be rolled. The meandering control includes a tail end roll force calculation unit that calculates a predictive value of roll force when entry side tension is not applied, an allowable meandering amount roll force calculation unit that calculates a reference value of the roll force applied to the material to be rolled when a meandering amount of the material to be rolled is an allowable amount, and a temperature rise amount calculation unit that calculates a temperature rise amount of
(Continued)

the material to be rolled, based on a difference between the predictive value of the roll force and the reference value of the roll force.

2 Claims, 8 Drawing Sheets

(52) U.S. Cl.
CPC ..... *B21B 2265/04* (2013.01); *B21B 2265/08* (2013.01); *B21B 2265/12* (2013.01)

(58) Field of Classification Search
CPC ..... B21B 2265/08; B21B 2265/12; B21B 38/006; B21B 37/00; B21B 37/68; B21B 37/72; B21B 37/76; B21B 2273/04; B21B 2273/16; B21B 2273/20; B21B 45/004; B21B 2045/006; B23Q 15/22; B23Q 15/24
See application file for complete search history.

(56) References Cited

U.S. PATENT DOCUMENTS

| | | | | | |
|---|---|---|---|---|---|
| 2014/0007637 | A1* | 1/2014 | Hayashi | ..... | B21B 37/68 72/200 |
| 2014/0129023 | A1* | 5/2014 | Dagner | ..... | G05B 15/02 700/148 |
| 2016/0339493 | A1* | 11/2016 | Ueno | ..... | B21C 51/00 |

FOREIGN PATENT DOCUMENTS

| | | | | | |
|---|---|---|---|---|---|
| JP | H08295949 | | * | 11/1996 | ..... C21D 1/00 |
| JP | 2004-237313 | A | | 8/2004 | |
| JP | 2004237313 | A | * | 8/2004 | |
| JP | 2007-237240 | A | | 9/2007 | |
| JP | 2009285694 | | * | 5/2008 | |
| JP | 2009-285694 | A | | 12/2009 | |
| JP | 2009285694 | A | * | 12/2009 | ..... B21B 37/00 |
| JP | 2011-218428 | A | | 11/2011 | |
| JP | 2011218428 | A | * | 11/2011 | |
| JP | 2011218428 | A | * | 11/2011 | ..... B21B 37/72 |
| KR | 1020110010502 | | * | 2/2011 | ..... B21B 39/14 |

OTHER PUBLICATIONS

Translation of JPH08295949A, Author: Yoshikatsu, Translated May 2019 (Year: 1995).*
Translation of JP-2011218428, Author: Inami, Translated May 2019 (Year: 2011).*
Translation of JP-04118186-A, Author: Kuroki, Translated Sep. 2020 (Year: 1992).*
Translation of JP-2004237313-A, Author: Yasuhiko, Translated Apr. 2020 (Year: 2004).*
English translation of the International Preliminary Report on Patentability dated Aug. 17, 2017 in PCT/JP2015/052805 filed Feb. 2, 2015.
International Search Report dated Mar. 3, 2015 in PCT/JP2015/052805 filed Feb. 2, 2015.

* cited by examiner

α, β, γ, η: COEFFICIENT DETERMINED DEPENDING ON ROLLING CONDITION
P: ROLL FORCE
V: VELOCITY OF ENTRY SIDE MATERIAL TO BE ROLLED
S: LAPLACIAN OPERATOR

MEANDERING CONTROL DEVICE FOR ROLLING LINE

FIELD

The present invention relates to a meandering control device for a rolling line.

BACKGROUND

PTL 1 discloses a meandering control device for a rolling line. According to the meandering control device, temperature distribution in the width direction of the material to be rolled is made uniform. Consequently, meandering of the material to be rolled can be suppressed.

CITATION LIST

Patent Literature

[PTL 1] JP 2007-237240 A

SUMMARY

Technical Problem

However, even in the case where the temperature distribution in the width direction of the material to be rolled is uniform, meandering of the material to be rolled may be caused. Regarding such a case, temperature of the material to be rolled, for suppressing meandering of the material to be rolled, is not set in the device described in PTL 1.

The present invention is made to solve the above-described problem. An object of the present invention is to provide a meandering control device for a rolling line capable of setting temperature of a material to be rolled such that meandering of the material to be rolled is suppressed even in the case where the temperature distribution in the width direction of the material to be rolled is uniform.

Solution to Problem

A meandering control device for a rolling line, according to the present invention, includes a tail end roll force calculation unit that calculates a predictive value of roll force applied to a material to be rolled by a rolling stand when entry side tension is not applied, based on the roll force applied to the material to be rolled by the rolling stand, entry side tension applied to the material to be rolled at an entry side of the rolling stand, delivery side tension applied to the material to be rolled at a delivery side of the rolling stand, and the temperature of the material to be rolled; an allowable meandering amount roll force calculation unit that calculates a reference value of the roll force applied to the material to be rolled when an meandering amount of the material to be rolled is an allowable amount, based on the allowable amount of the meandering of the material to be rolled when the entry side tension is not applied, a difference in the roll force applied to the material to be rolled by the rolling stand between one side and the other side, and the velocity of the material to be rolled at the entry side of the rolling stand; and a temperature rise amount calculation unit that calculates a temperature rise amount of the material to be rolled, based on a difference between the predictive value of the roll force calculated by the tail end roll force calculation unit and the reference value of the roll force calculated by the allowable meandering amount roll force calculation unit.

Advantageous Effects of Invention

According to the present invention, an amount of temperature rise of the material to be rolled is calculated regardless of the temperature distribution in the width direction of the material to be rolled. Therefore, even in the case where the temperature distribution in the width direction of the material to be rolled is uniform, it is possible to set the temperature of the material to be rolled so as to suppress meandering of the material to be rolled.

DESCRIPTION OF EMBODIMENTS

Figure 1:
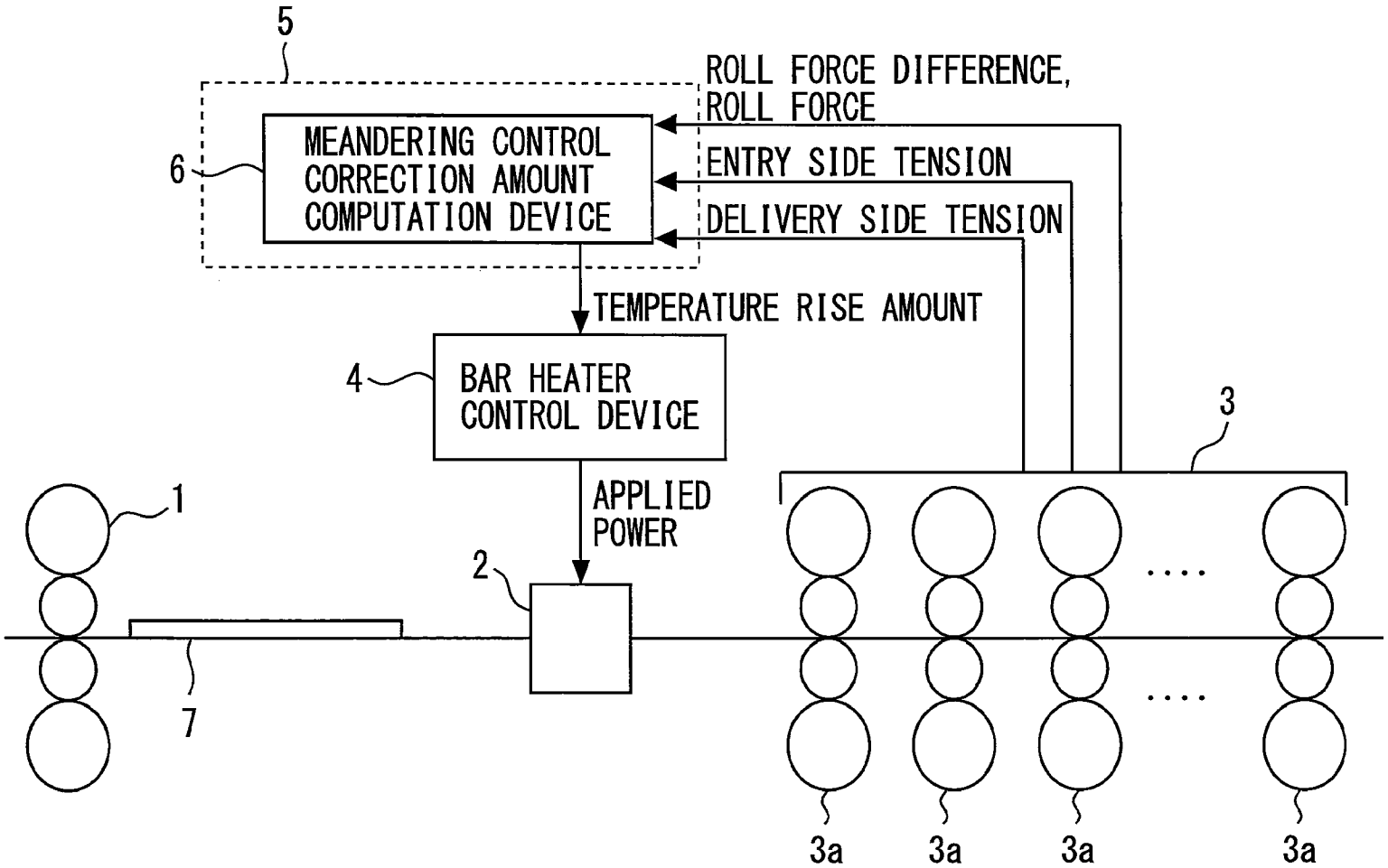
FIG. 1 is a configuration diagram of a rolling line to which a meandering control device for a rolling line according to a first embodiment of the present invention is applied.

Embodiments for carrying out the present invention will be described in accordance with the accompanying drawings. It should be noted that in the drawings, the same or corresponding parts are denoted by the same reference signs. Repetition of the description of such parts is simplified or omitted as appropriate.

First Embodiment

FIG. 1 is a configuration diagram of a rolling line to which a meandering control device for a rolling line according to a first embodiment of the present invention is applied.

In FIG. 1, a roughing mill 1 is disposed nearest to the entry side of the rolling line. A bar heater 2 is provided to the delivery side of the roughing mill 1. A finishing mill 3 is provided to the delivery side of the bar heater 2. The finishing mill 3 includes a plurality of rolling stands 3*a*. The rolling stands 3*a* are aligned along the rolling line.

An output unit of a bar heater control device 4 is connected with an input unit of the bar heater 2. A meandering control device 5 has a meandering control correction amount computation device 6. An input unit of the meandering control correction amount computation device 6 is connected with a device provided to each of the rolling stands 3*a*. An output unit of the meandering control correction amount computation device 6 is connected with an input unit of the bar heater control device 4.

In the hot rolling step of the rolling line, a material to be rolled 7 is rolled by the roughing mill 1. Then, the material to be rolled 7 is heated by the bar heater 2. Then, the material to be rolled 7 is rolled by the finishing mill 3. At that time, at each of the rolling stands 3*a*, roll force applied to the material to be rolled 7, a difference in roll force applied to the material to be rolled 7 between one side and the other side, and the like are measured.

The meandering control correction amount computation device 6 calculates a predictive value of the meandering amount at the tail end of the material to be rolled 7 with use of at least one of a measurement value and a set value. The meandering control correction amount computation device 6 calculates temperature of the material to be rolled 7 required for suppressing meandering of the material to be rolled 7 corresponding to the predictive value. The meandering control correction amount computation device 6 calculates a temperature rise amount of the material to be rolled 7 based on the calculation result. The meandering control correction amount computation device 6 outputs a signal corresponding to the temperature rise amount, to the bar heater control device 4.

The bar heater control device 4 calculates electric power consumption of the bar heater 2 based on the temperature rise amount corresponding to the signal. The bar heater control device 4 applies the power to the bar heater 2.

Figure 2:
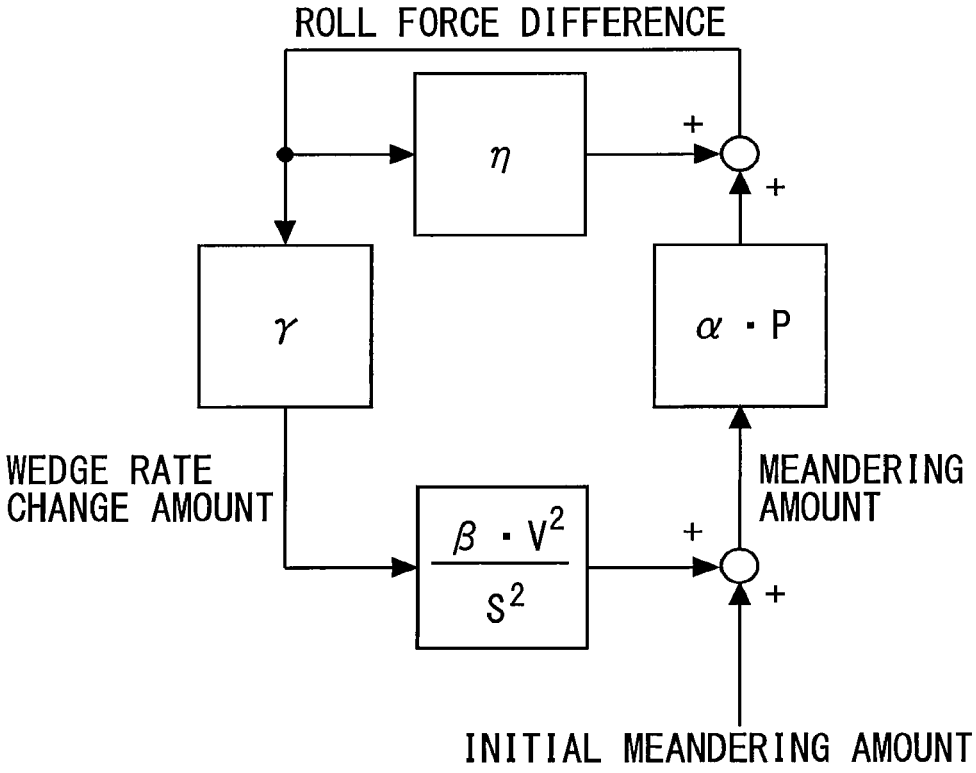
FIG. 2 is a diagram illustrating a model of calculating a meandering amount of a material to be rolled in the rolling line to which the meandering control device for a rolling line according to the first embodiment of the present invention is applied.

Next, meandering of the material to be rolled 7 will be described with use of FIG. 2. FIG. 2 is a diagram illustrating a model of calculating a meandering amount of the material to be rolled in the rolling line to which the meandering control device for a rolling line according to the first embodiment of the present invention is applied.

The model illustrated in FIG. 2 is one in which a meandering amount calculation model in rolling known as a general knowledge in a tensionless state is simplified. When a difference in roll force applied to the material to be rolled 7 between one side and the other side is caused due to some reasons, a wedge rate change amount varies. The wedge rate change amount is a difference, between the entry side and the delivery side, in the thickness difference between the one side and the other side of the material to be rolled 7 (wedge rate). As a result that the wedge rate change amount is integrated, meandering is caused in the material to be rolled 7. When meandering is caused in the material to be rolled 7, a difference in roll force applied to the material to be rolled 7 between the one side and the other side is increased. As such, the wedge rate is further changed. Consequently, meandering in the material to be rolled 7 is increased.

Next, the meandering control correction amount computation device 6 will be described with use of FIG. 3.

Figure 3:
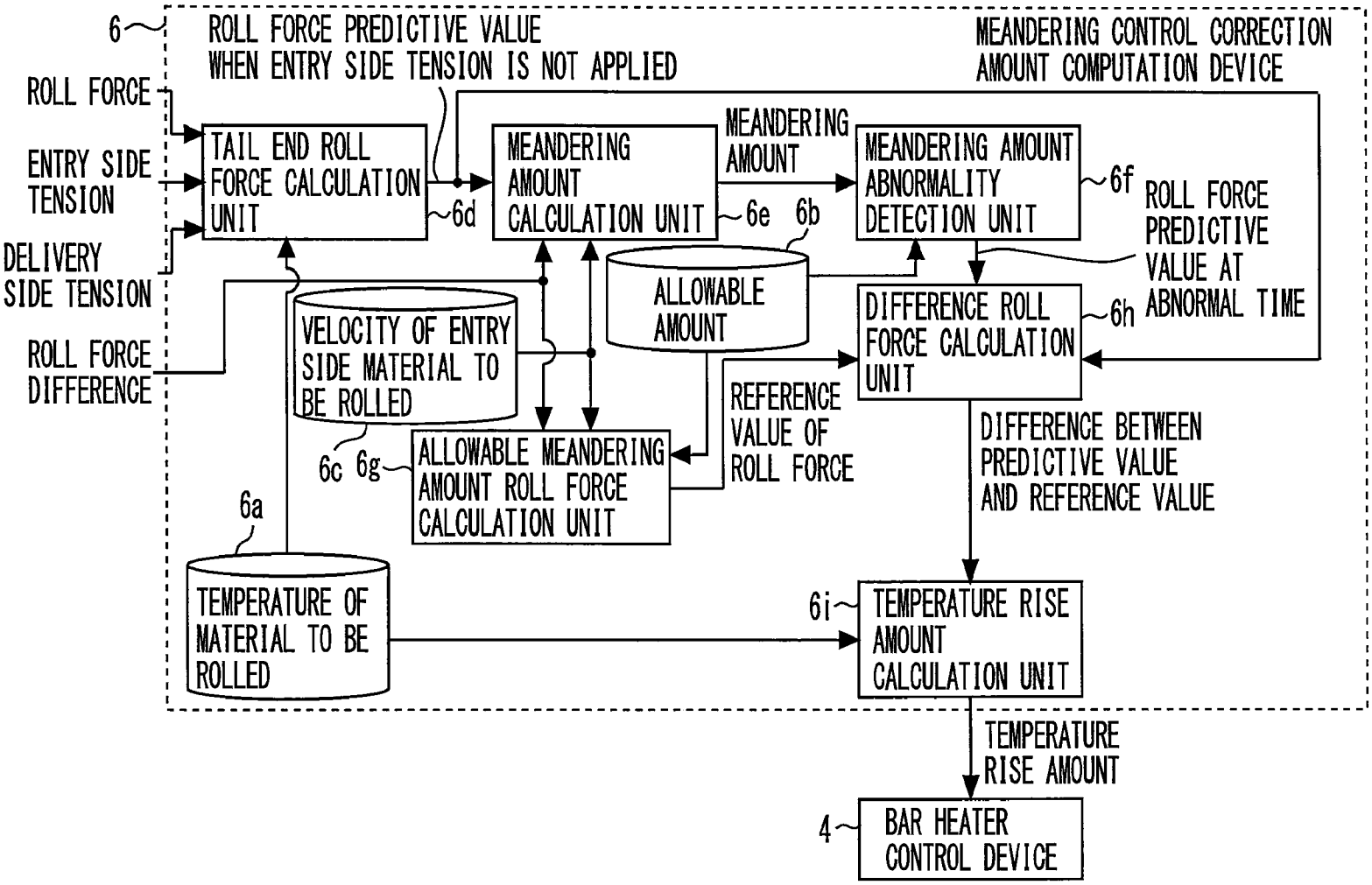
FIG. 3 is a block diagram of a meandering control correction amount computation device provided to the meandering control device for the rolling line according to the first embodiment of the present invention.

FIG. 3 is a block diagram of the meandering control correction amount computation device provided to the meandering control device for a rolling line according to the first embodiment of the present invention.

As illustrated in FIG. 3, the meandering control correction amount computation device 6 includes a first storage unit 6*a*, a second storage unit 6*b*, a third storage unit 6*c*, a tail end roll force calculation unit 6*d*, a meandering amount calculation unit 6*e*, a meandering amount abnormality detection unit 6*f*, an allowable meandering amount roll force calculation unit 6*g*, a difference roll force calculation unit 6*h*, and a temperature rise amount calculation unit 6*i*.

The first storage unit 6*a* temporarily stores therein information corresponding to the temperature of the material to be rolled 7. The second storage unit 6*b* temporarily stores therein information corresponding to the allowable amount of meandering of the material to be rolled 7. The third storage unit 6*c* temporarily stores therein information corresponding to a velocity V of the material to be rolled 7 at the entry side of the rolling stand 3*a*.

When rolling is stable, the tail end roll force calculation unit 6*d* calculates a predictive value of the roll force applied to the material to be rolled 7 by the rolling stand 3*a* when the entry side tension is not applied. At that time, the tail end roll force calculation unit 6*d* calculates a predictive value $P_0$ (kN) of the roll force, based on roll force $P_{ACT}$ (kN) applied to the material to be rolled 7 by the rolling stand 3*a*, entry side tension $\sigma_{e,ACT}$ (MPa) applied to the material to be rolled 7 at the entry side of the rolling stand 3*a*, delivery side tension $\Sigma_{x,ACT}$ (MPa) applied to the material to be rolled 7 at the delivery side of the rolling stand 3*a*, and temperature $T_{strip}$ (° C.) of the material to be rolled 7 in finishing rolling.

For example, the tail end roll force calculation unit 6*d* uses a roll force calculation formula expressed as Expression (1) provided below.

$$P=fp(\sigma_e,\sigma_x,T_{strip}\ldots) \tag{1}$$

Specifically, the tail end roll force calculation unit 6*d* calculates the predictive value $P_0$ (kN) of the roll force using Expressions (2) to (4) provided below.

$$P_{ACAL}=fp(\sigma_{e,ACT},\sigma_{x,ACT},T_{strip}\ldots) \tag{2}$$

$$\beta=P_{ACT}/P_{ACAL} \tag{3}$$

$$P_0=\beta\cdot fp(\sigma_{e0,ACT},\sigma_{x,ACT},T_{strip}\ldots) \tag{4}$$

Here, $\sigma_{e0}$ takes 0.

The meandering amount calculation unit 6*e* calculates a meandering amount $y_c$ (mm) of the material to be rolled 7, based on the predictive value $P_0$ of the roll force calculated by the tail end roll force calculation unit 6*d*, a difference $\delta P$ (kN) in roll force applied to the material to be rolled 7 by the rolling stand 3*a*, between one side and the other side, and the velocity V (m/s) of the material to be rolled 7 at the entry side of the rolling stand 3*a*. For example, the difference $\delta P$ in roll force between one side and the other side is calculated from a roll force $P_{WS}$ (kN) at the work side and the roll force $P_{DS}$ (kN) at the drive side from a load cell (not shown) provided to each of the rolling stands 3*a*.

For example, the meandering amount calculation unit 6*e* calculates the meandering amount $y_c$ of the material to be rolled 7 using the meandering amount prediction formula expressed by Expression (5) provided below.

$$y_c=fy_c(\delta P,P_0,V,\ldots) \tag{5}$$

The meandering amount abnormality detection unit 6*f* determines whether or not the meandering amount $y_c$ of the material to be rolled 7 exceeds an allowable amount $y_c'$. The meandering amount abnormality detection unit 6*f* detects abnormality when the material to be rolled 7 exceeds the allowable amount $y_c'$. The allowable amount $y_c'$ is set corresponding to a situation causing a rolling trouble that interrupts operation. For example, the allowable amount $y_c'$ is set corresponding to a situation where the material to be rolled 7 is drawn due to meandering. For example, the allowable amount $y_c'$ is set corresponding to a situation where the material to be rolled 7 is brought into contact with a side portion of the finishing mill 3. For example, the allowable amount $y_c'$ is set corresponding to a situation where equipment such as the rolling stand 3*a* is broken.

The allowable meandering amount roll force calculation unit 6*g* calculates a reference value $P_0'$ (kN) of the roll force applied to the material to be rolled 7 when the meandering amount $y_c$ of the material to be rolled 7 is an allowable amount $y_c'$.

For example, the allowable meandering amount roll force calculation unit 6*g* calculates a reference value $P_0'$ of the roll force by using an inverse function of the function expressed by Expression (5). The allowable meandering amount roll force calculation unit 6*g* calculates the reference value $P_0'$ of the roll force by using Expression (6) provided below.

$$P_0' = fyc'^{-1}(\delta P, V, y_c', \ldots) \quad (6)$$

The difference roll force calculation unit 6*h* does not calculate a difference ΔP (kN) between the predictive value $P_0$ and the reference value $P_0'$ when the meandering amount abnormality detection unit 6*f* does not detect abnormality. When the meandering amount abnormality detection unit 6*f* detects abnormality, the difference roll force calculation unit 6*h* calculates a difference ΔP between the predictive value $P_0$ and the reference value $P_0'$. The difference ΔP between the predictive value $P_0$ and the reference value $P_0'$ is expressed by Expression (7) provided below.

$$\Delta P = P_0 - P_0' \quad (7)$$

The temperature rise amount calculation unit 6*i* calculates a temperature rise amount $\Delta T_{BH}$ (° C.) of the material to be rolled 7 required for eliminating the difference ΔP between the predictive value $P_0$ and the reference value $P_0'$. The temperature rise amount $\Delta T_{BH}$ is a temperature rise amount when the temperature of the material to be rolled 7 is raised by the bar heater 2.

For example, the temperature rise amount calculation unit 6*i* calculates the temperature rise amount $\Delta T_{BH}$ of the material to be rolled 7 by using a temperature prediction formula for the material to be rolled, expressed by Expression (8) provided below.

$$\Delta T_{BH} = fi(\Delta P, T_{strip}, \ldots) \quad (8)$$

These calculations are performed on all of the rolling stands 3*a*. The temperature rise amount calculation unit 6*i* outputs, to the bar heater control device 4, a signal corresponding to a temperature rise amount $\Delta T_{BH}$ having the largest value among the temperature rise amounts $\Delta T_{BH}$ of the material to be rolled 7 calculated for all of the rolling stands 3*a*.

The bar heater control device 4 calculates power consumption Pw of the bar heater 2 satisfying the temperature rise amount $\Delta T_{BH}$ of the material to be rolled 7 corresponding to the signal from the temperature rise amount calculation unit 6*i*. The bar heater control device 4 controls heating by the bar heater 2, based on the calculation result. By the heating, the roll force applied to the material to be rolled 7 is decreased. Consequently, meandering of the material to be rolled 7 is suppressed.

Next, an exemplary hardware configuration of the meandering control correction amount computation device 6 will be described using FIG. 4.

Figure 4:
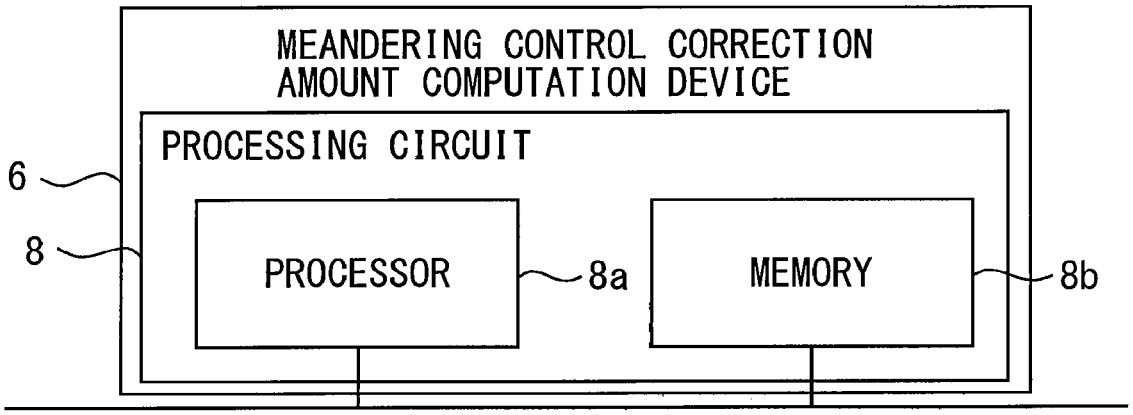
FIG. 4 is a hardware configuration diagram of the meandering control device for a rolling line according to the first embodiment of the present invention.

FIG. 4 is a hardware configuration diagram of the meandering control correction amount computation device provided to the meandering control device for a rolling line according to the first embodiment of the present invention.

As illustrated in FIG. 4, the meandering control correction amount computation device 6 includes a processing circuit 8. The processing circuit 8 includes a processor 8*a* and a memory 8*b*. Operation of each unit of the meandering control device 5 in FIG. 3 is realized by executing a program stored in at least one memory 8*b* by at least one processor 8*a*.

According to the first embodiment described above, the temperature rise amount of the material to be rolled 7 is calculated regardless of the temperature distribution in the width direction of the material to be rolled 7. Accordingly, even in the case where the temperature distribution in the width direction of the material to be rolled 7 is uniform, the temperature of the material to be rolled 7 can be set so as to suppress meandering of the material to be rolled 7. As a result, it is possible to suppress breakage and drawing of the material to be rolled 7, and to suppress damage to the equipment of the rolling line. Consequently, it is possible to suppress deterioration in the yield of products and a decrease in productivity due to rolling.

Further, the meandering amount of the material to be rolled 7 is obtained from calculation performed by the meandering amount calculation unit 6*e*. Accordingly, it is possible to suppress meandering of the material to be rolled 7 without providing a pyrometer for measuring temperature distribution in the width direction of the material to be rolled 7 and a meandering meter.

Further, the temperature rise amount of the material to be rolled 7 is calculated only when abnormality in the meandering of the material to be rolled 7 is detected. Accordingly, a calculation load by the meandering control correction amount computation device 6 can be suppressed.

It should be noted that a meandering meter may be provided on the delivery side of the finishing mill 3. In that case, abnormality may be detected when the meandering amount of the material to be rolled 7 measured by the meandering meter exceeds the allowable amount.

Second Embodiment

Figure 5:
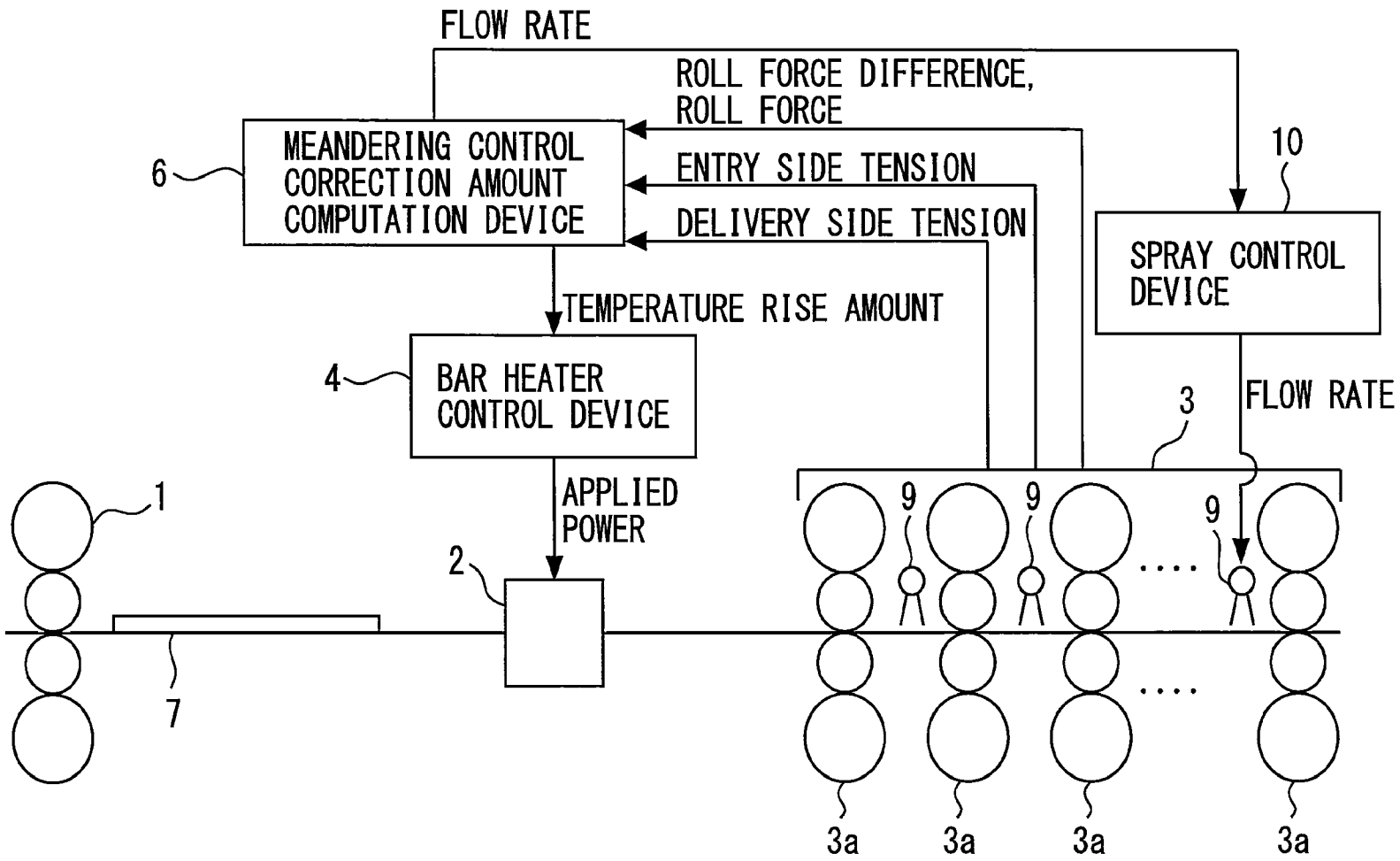
FIG. 5 is a configuration diagram of a rolling line to which a meandering control device for a rolling line according a second embodiment of the present invention is applied.

FIG. 5 is a configuration diagram of a rolling line to which a meandering control device for a rolling line according to a second embodiment of the present embodiment is applied. It should be noted that parts that are the same as or corresponding to those of the first embodiment are denoted by the same reference signs, and the description thereof is omitted.

The rolling line of the second embodiment is one in which a plurality of sprays 9 and a spray control device 10 are added to the rolling line of the first embodiment.

Each of the sprays 9 is provided between adjacent rolling stands 3*a*. An output unit of the spray control device 10 is connected with an input unit of the spray 9. An input unit of the spray control device 10 is connected with an output unit of the meandering control correction amount computation device 6.

For example, the meandering control correction amount computation device 6 calculates the flow rate of the water provided by the spray 9 disposed nearest to the delivery side such that the material to be rolled 7 takes a target temperature, based on the temperature rise amount of the material to be rolled 7. The spray control device 10 controls the material to be rolled 7 by the spray 9 disposed nearest to the delivery side based on the flow rate of the water calculated by the meandering control correction amount computation device 6.

Next, the meandering control correction amount computation device 6 will be described using FIG. 6.

Figure 6:
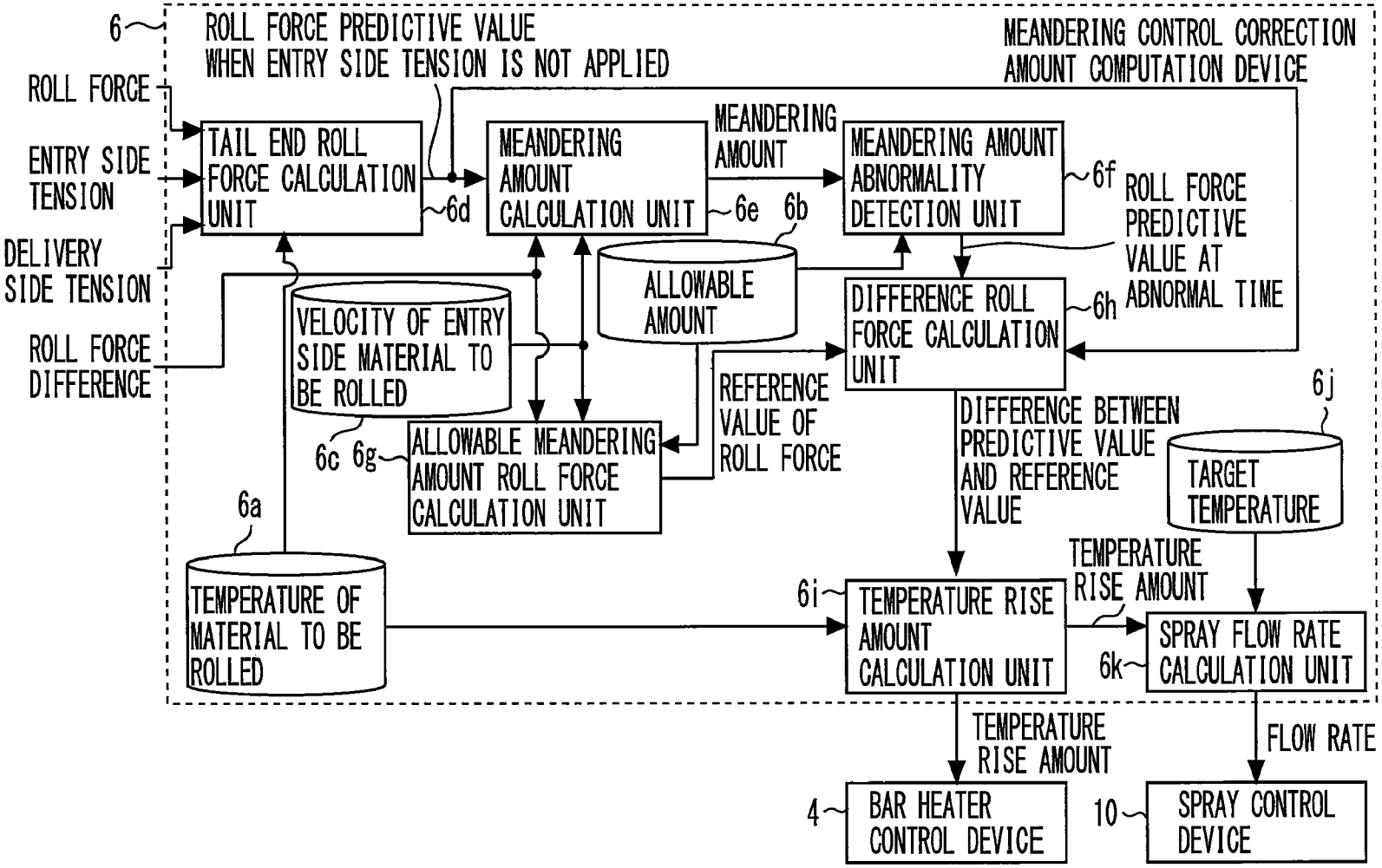
FIG. 6 is a block diagram of a meandering control correction amount computation device provided to the meandering control device for a rolling line according to the second embodiment of the present invention.

FIG. 6 is a block diagram of a meandering control correction amount computation device provided to the meandering control device for a rolling line according to the second embodiment of the present invention.

As illustrated in FIG. 6, the meandering control correction amount computation device 6 of the second embodiment is one in which a fourth storage unit 6*j* and a spray flow rate calculation unit 6*k* are added to the meandering control correction amount computation device 6 of the first embodiment.

The fourth storage unit 6*j* temporarily stores therein information corresponding to target temperature $T_{FD,TG}$ (° C.) of the material to be rolled 7.

The spray flow rate calculation unit 6*k* calculates a flow rate $F_{SP}$ of the water provided by the spray 9, based on the temperature rise amount $\Delta T_{BH}$ of the material to be rolled 7 calculated by the temperature rise amount calculation unit 6*i* and the target temperature $T_{FD,TG}$.

For example, the spray flow rate calculation unit 6*k* calculates the flow rate $F_{SP}$ of the water provided by the spray 9 with use of a spray flow rate prediction formula expressed by Expression (9) provided below.

$$F_{SP}=ff(\Delta T_{BH},T_{FD,TG},\ldots) \tag{9}$$

In Expression (9), the flow rate $F_{SP}$ of the water provided by the spray 9 is calculated as a ratio (%) to the maximum flow rate.

The spray flow rate calculation unit 6*k* outputs a signal corresponding to the flow rate $F_{SP}$ of the water provided by the spray 9, to the spray control device 10.

The spray control device 10 outputs, to the spray 9, a signal corresponding to the change amount of the flow rate of the water, based on the flow rate $F_{SP}$ corresponding to the signal from the spray flow rate calculation unit 6*k*. The spray 9 changes the flow rate of the water according to the flow rate $F_{SP}$ of the water corresponding to the signal from the spray control device 10.

According to the second embodiment described above, the spray 9 is controlled such that the material to be rolled 7 takes a target temperature. Therefore, it is possible to reduce the possibility of adversely affecting the quality of the material to be rolled 7.

In that case, it is only necessary to control any of the sprays 9 provided to the delivery side of the rolling stand 3*a* where meandering of the material to be rolled 7 is predicted. For example, the material to be rolled 7 may be cooled by only one spray 9, or the material to be rolled 7 may be cooled by a plurality of sprays 9 distributively.

Third Embodiment

Figure 7:
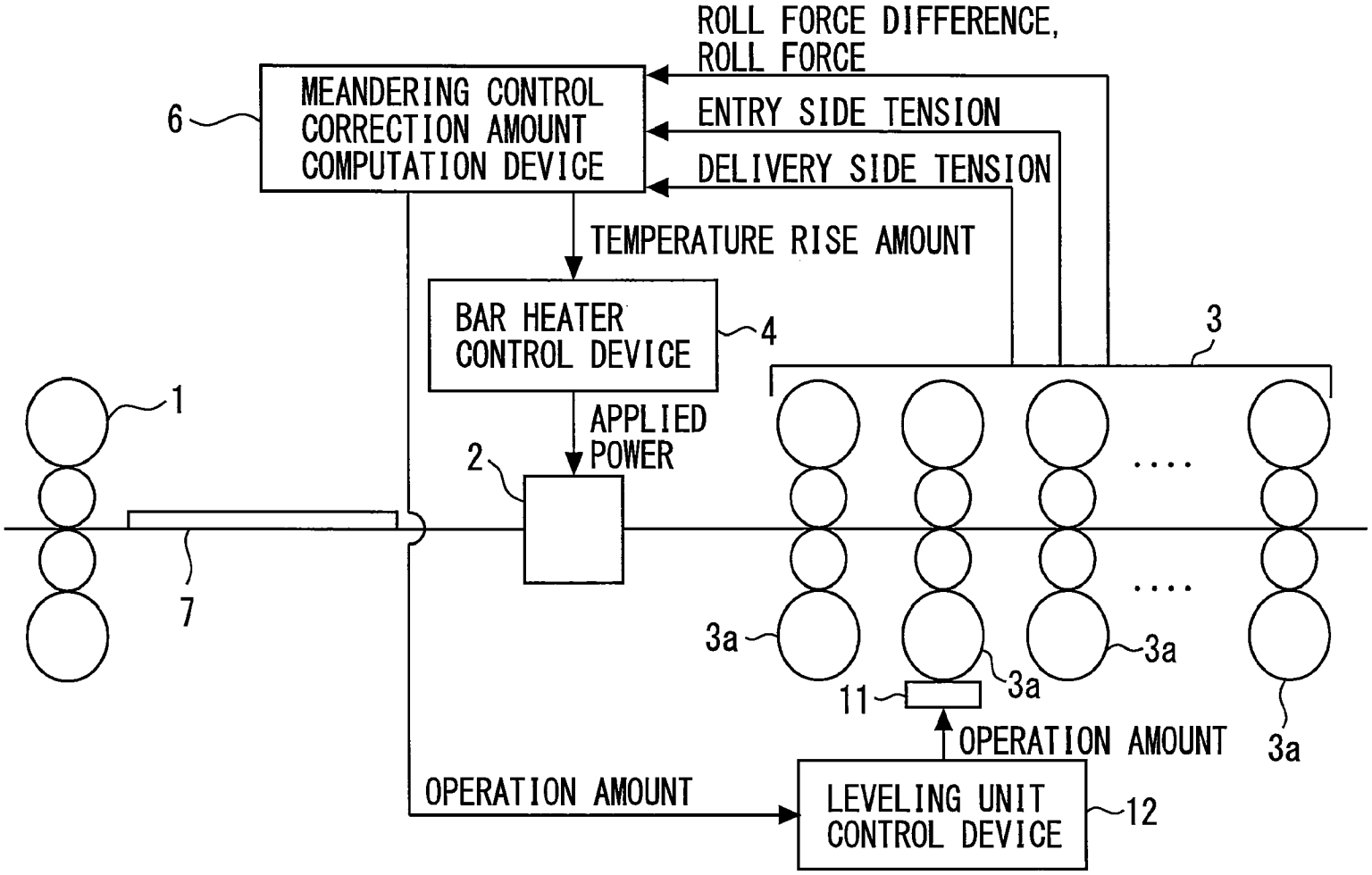
FIG. 7 is a configuration diagram of a rolling line to which a meandering control device for a rolling line according to a third embodiment of the present invention is applied.

FIG. 7 is a configuration diagram of a rolling line to which a meandering control device for a rolling line according to a third embodiment of the present invention is applied. It should be noted that parts that are the same as or corresponding to those of the first embodiment are denoted by the same reference signs, and the description thereof is omitted.

The rolling line of the third embodiment is one in which a plurality of leveling units 11 and a leveling unit control device 12 are added to the rolling line of the first embodiment.

Each of the leveling units 11 is provided to each of the rolling stand 3*a*. It should be noted that FIG. 7 shows only one leveling unit 11. An output unit of the leveling unit control device 12 is connected with an input unit of the leveling unit 11. An input unit of the leveling unit control device 12 is connected with an output unit of the meandering control correction amount computation device 6.

For example, when the temperature rise amount of the material to be rolled 7 exceeds a possible temperature rise of the bar heater 2, the meandering control correction amount computation device 6 calculates a meandering amount of the material to be rolled 7 corresponding to the temperature rise amount exceeding the possible temperature rise. The meandering control correction amount computation device 6 calculates the operation amount of the leveling unit 11 so as to offset the meandering amount. The leveling unit control device 12 controls the leveling unit 11 so as to reduce the wedge rate of the material to be rolled 7, based on the operation amount calculated by the meandering control correction amount computation device 6.

Next, the meandering control correction amount computation device 6 will be described using FIG. 8.

Figure 8:
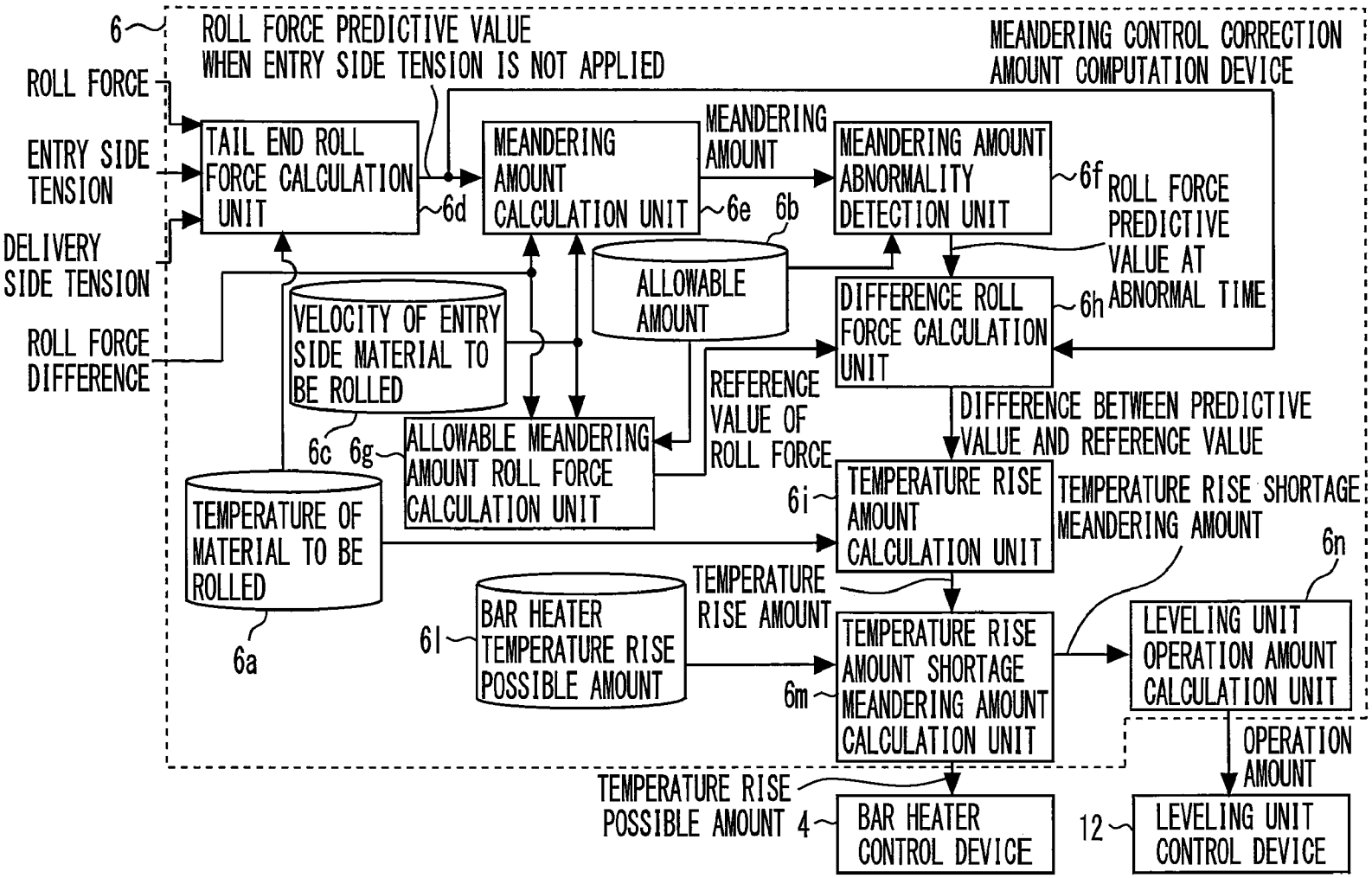
FIG. 8 is a block diagram of a meandering control correction amount computation device provided to the meandering control device for a rolling line according to the third embodiment of the present invention.

FIG. 8 is a block diagram of the meandering control correction amount computation device provided to the meandering control device for a rolling line according to the third embodiment of the present invention.

As illustrated in FIG. 8, the meandering control correction amount computation device 6 of the second embodiment is one in which a fifth storage unit 6*l*, a temperature rise amount shortage meandering amount calculation unit 6*m*, and a leveling unit operation amount calculation unit 6*n* are added to the meandering control correction amount computation device 6 of the first embodiment.

The fifth storage unit 6*l* temporarily stores therein information corresponding to the temperature rise possible amount $\Delta T_{BH,UL}$ (° C.) of the bar heater 2.

The temperature rise amount shortage meandering amount calculation unit 6*m* calculates a temperature rise possible amount $\Delta T_{BH}''$ (° C.) of the material to be rolled 7 and a meandering amount $\Delta y_c''$ (mm) of the material to be rolled 7 for the shortage of the temperature rise amount, based on a temperature rise amount $\Delta T_{BH}$ of the material to be rolled 7 and a temperature rise possible amount $\Delta T_{BH,UL}$ (° C.) of the bar heater 2.

For example, when the temperature rise amount $\Delta T_{BH}$ of the material to be rolled 7 is equal to or larger than the temperature rise possible amount $\Delta T_{BH,UL}$ of the bar heater 2, the temperature rise amount shortage meandering amount calculation unit 6*m* calculates the temperature rise possible amount $\Delta T_{BH}''$ of the material to be rolled 7 and the meandering amount $\Delta y_c''$ of the material to be rolled 7 for the shortage of the temperature rise amount by using Expressions (10) and (11) provided below.

$$\Delta T_{BH}''=\Delta T_{BH,UL} \tag{10}$$

$$\Delta y_c''=fy_c(\delta P,fp(\Delta T_{BH}-\Delta T_{BH,UL}),V,\ldots) \tag{11}$$

For example, when the temperature rise amount $\Delta T_{BH}$ of the material to be rolled 7 is less than the temperature rise possible amount $\Delta T_{BH,UL}$ of the bar heater 2, the temperature rise amount shortage meandering amount calculation unit 6*m* calculates the temperature rise possible amount $\Delta T_{BH}''$ of the material to be rolled 7 and the meandering amount $\Delta y_c''$ of the material to be rolled 7 for the shortage of the temperature rise amount by using Expressions (12) and (13) provided below.

$$\Delta T_{BH}''=\Delta T_{BH} \tag{12}$$

$$\Delta y_c''=0 \tag{13}$$

The temperature rise amount shortage meandering amount calculation unit 6*m* outputs a signal corresponding to the temperature rise possible amount $\Delta T_{BH}''$ of the material to be rolled 7, to the bar heater control device 4. The temperature rise amount shortage meandering amount calculation unit 6*m* outputs a signal corresponding to the meandering amount $\Delta y_c''$ of the material to be rolled 7 for the shortage of the temperature rise amount, to the leveling unit operation amount calculation unit 6*n*.

The leveling unit operation amount calculation unit 6*n* calculates an operation amount δS (mm) of the leveling unit based on the meandering amount $\Delta y_c''$ of the material to be rolled 7 for the shortage of the temperature rise amount corresponding to the signal from the temperature rise amount shortage meandering amount calculation unit 6*m*.

The leveling unit operation amount calculation unit 6*n* calculates an operation amount δS of the leveling unit by using a leveling operation amount prediction formula expressed by Expression (14) provided below.

$$\delta S = f\delta S(\Delta y_c'', \ldots) \quad (14)$$

The leveling unit operation amount calculation unit 6*n* outputs a signal corresponding to the operation amount δS of the leveling to the leveling unit control device 12. The leveling unit control device 12 operates the leveling unit 11 with the operation amount δS corresponding to the signal from the leveling unit operation amount calculation unit 6*n*.

According to the third embodiment described above, when the temperature rise amount of the material to be rolled 7 exceeds the temperature rise possible amount of the bar heater 2, the leveling unit 11 is operated. Therefore, even when the temperature rise amount of the material to be rolled 7 exceeds the temperature rise possible amount of the bar heater 2, meandering of the material to be rolled 7 can be controlled.

INDUSTRIAL APPLICABILITY

As described above, the meandering control device for a rolling line according to the present invention is applicable to a system that sets temperature of a material to be rolled in such a manner as to control meandering of the material to be rolled even when the temperature distribution in the width direction of the material to be rolled is uniform.

REFERENCE SIGNS LIST

1 Roughing mill, 2 Bar heater, 3 Finishing mill, 3*a* Rolling stand, 4 Bar heater control device, 5 Meandering control device, 6 Meandering control correction amount computation device, 6*a* First storage unit, 6*b* Second storage unit, 6*c* Third storage unit, 6*d* Tail end roll force calculation unit, 6*e* Meandering amount calculation unit, 6*f* Meandering amount abnormality detection unit, 6*g* Allowable Meandering amount roll force calculation unit, 6*h* Difference roll force calculation unit, 6*i* Temperature rise amount calculation unit, 6*j* Fourth storage unit, 6*k* Spray flow rate calculation unit, 6*l* Fifth storage unit, 6*m* Temperature rise amount shortage Meandering amount calculation unit, 6*n* Leveling unit operation amount calculation unit, 7 Material to be rolled, 8 Processing circuit, 8*a* Processor, 8*b* Memory, 9 Spray, 10 Spray control device, 11 Leveling unit, 12 Leveling unit control device.

The invention claimed is:

1. A meandering control device for a rolling line, the device comprising:

a tail end roll force calculator that calculates a predictive value of roll force applied to a material to be rolled by a rolling stand when entry side tension is not applied, based on the roll force applied to the material to be rolled by the rolling stand, entry side tension applied to the material to be rolled at an entry side of the rolling stand, delivery side tension applied to the material to be rolled at a delivery side of the rolling stand, and temperature of the material to be rolled;

an allowable meandering amount roll force calculator that calculates a reference value of the roll force applied to the material to be rolled when a meandering amount of the material to be rolled is an allowable amount, based on the allowable amount of the meandering of the material to be rolled when the entry side tension is not applied, a difference in the roll force applied to the material to be rolled by the rolling stand between one side and another side, and velocity of the material to be rolled at the entry side of the rolling stand;

a temperature rise amount calculator that calculates a temperature rise amount of the material to be rolled, based on a difference between the predictive value of the roll force calculated by the tail end roll force calculator and the reference value of the roll force calculated by the allowable meandering amount roll force calculator and outputs, a signal corresponding to the temperature rise amount;

a bar heater controller that controls a bar heater before the entry side of the rolling stand that heats the material to be rolled in accordance with the signal output by the temperature rise amount calculator to suppress meandering of the material when being rolled;

a temperature rise amount shortage meandering amount calculator that, when the temperature rise amount of the material to be rolled calculated by the temperature rise amount calculator exceeds a heating temperature that the bar heater can reach, calculates a meandering amount of the material to be rolled corresponding to a temperature rise amount shortage exceeding the heating temperature that the bar heater can reach;

a leveling unit operation amount calculator that calculates an operation amount of a leveling unit that adjusts the rolling stand so as to offset the meandering amount of the material to be rolled corresponding to the temperature rise amount shortage exceeding the heating temperature that the bar heater can reach;

the bar heater controller controls the bar heater in accordance with the heating temperature that the bar heater can reach; and a leveling unit controller operating the leveling unit in accordance with the operation amount output from the leveling unit operation amount calculator.

2. A non-transitory computer readable medium having stored thereon a program that, when executed by a computer, causes the computer to execute processing, the processing comprising:

calculating a predictive value of roll force applied to a material to be rolled by a rolling stand when entry side tension is not applied, based on the roll force applied to the material to be rolled by the rolling stand, entry side tension applied to the material to be rolled at an entry side of the rolling stand, delivery side tension applied to the material to be rolled at a delivery side of the rolling stand, and temperature of the material to be rolled;

calculating a reference value of the roll force applied to the material to be rolled when a meandering amount of the material to be rolled is an allowable amount, based on the allowable amount of the meandering of the material to be rolled when the entry side tension is not applied, a difference in the roll force applied to the material to be rolled by the rolling stand between one side and another side, and velocity of the material to be rolled at the entry side of the rolling stand;

calculating a temperature rise amount of the material to be rolled, based on a difference between the predictive value of the roll force and the reference value of the roll force and output a signal corresponding to the temperature rise amount;

controlling a bar heater before the entry side of the rolling stand that heats the material to be rolled in accordance with the signal corresponding to the temperature rise amount to suppress meandering of the material when being rolled; and on condition that the temperature rise amount of the material to be rolled exceeds a heating temperature that the bar heater can reach, calculating a meandering amount of the material to be rolled corresponding to a temperature rise amount shortage exceeding the heating temperature that the bar heater can reach, calculating an operation amount of a leveler that adjusts the rolling stand so as to offset the meandering amount of the material to be rolled corresponding to the temperature rise amount shortage exceeding the heating temperature that the bar heater can reach;

controlling the bar heater in accordance with the heating temperature that the bar heater can reach; and operating the leveler in accordance with the operation amount.

* * * * *